US011280232B2

(12) United States Patent
Pekovic et al.

(10) Patent No.: US 11,280,232 B2
(45) Date of Patent: Mar. 22, 2022

(54) SYSTEM AND METHOD FOR MONITORING ENGINE FLUID LEVELS

(71) Applicant: PRATT & WHITNEY CANADA CORP., Longueuil (CA)

(72) Inventors: Tatjana Pekovic, St-Lambert (CA); John Correia, Pierrefonds (CA); Robert Pontarelli, Brossard (CA); Andre Ip, Brossard (CA)

(73) Assignee: PRATT & WHITNEY CANADA CORP., Longueil (CA)

( * ) Notice: Subject to any disclaimer, the term of this patent is extended or adjusted under 35 U.S.C. 154(b) by 382 days.

(21) Appl. No.: 16/551,134

(22) Filed: Aug. 26, 2019

(65) Prior Publication Data

US 2021/0062694 A1 Mar. 4, 2021

(51) Int. Cl.
*F01M 11/12* (2006.01)

(52) U.S. Cl.
CPC ..... *F01M 11/12* (2013.01); *F01M 2250/60* (2013.01)

(58) Field of Classification Search
CPC ..... F01M 11/12; F01M 2250/60
See application file for complete search history.

(56) References Cited

U.S. PATENT DOCUMENTS

| | | | | |
|---|---|---|---|---|
| 5,382,942 | A | 1/1995 | Raffa et al. | |
| 7,904,229 | B2 | 3/2011 | Walthall et al. | |
| 8,887,509 | B2 * | 11/2014 | Bonner | F02C 7/06 60/772 |
| 9,404,403 | B2 | 8/2016 | McDonald | |

* cited by examiner

*Primary Examiner* — Jacob M Amick
*Assistant Examiner* — Charles J Brauch
(74) *Attorney, Agent, or Firm* — Norton Rose Fulbright Canada LLP

(57) ABSTRACT

Methods and Systems for monitoring an engine fluid level in a fluid recipient are described. In one example, the method comprises, during a fluid replenishing procedure, detecting when the fluid level reaches a level associated with the recipient being full; in response to the detecting, triggering a timer corresponding to a predetermined number of operating hours of the engine based on a fluid volume capacity of the fluid recipient; when the timer expires, verifying the fluid level; and issuing a first alert signal when the fluid level is at the level associated with the recipient being full and the timer has expired.

20 Claims, 5 Drawing Sheets

SYSTEM AND METHOD FOR MONITORING ENGINE FLUID LEVELS

TECHNICAL FIELD

The present disclosure relates generally to engines, and more particularly to monitoring of fluid levels for engines.

BACKGROUND OF THE ART

Certain types of engines, such as aircraft gas turbine engines, consume oil during operation. Oil consumption is dependent upon operating conditions and engine characteristics and thus varies from one engine to another. Dispatching an aircraft with an insufficient quantity of engine oil can lead to an inflight shutdown of the engine.

Traditionally, engine oil levels are visually inspected through an oil tank sight glass or with a dipstick to ensure the oil level is sufficient prior to dispatch. However, an engine oil tank when full, typically contains a quantity of oil that is sufficient for tens of flight hours of operation, which can generally last for several flights, even for an engine with a high oil level consumption rate. Therefore, oil level inspections are not necessary prior to each flight. Improvements are needed.

SUMMARY

In accordance with a broad aspect, there is provided a method for monitoring an engine fluid level in a fluid recipient. The method comprises during a fluid replenishing procedure, detecting when the fluid level reaches a level associated with the recipient being full; in response to the detecting, triggering a timer corresponding to a predetermined number of operating hours of the engine based on a fluid volume capacity of the fluid recipient; when the timer expires, verifying the fluid level; and issuing a first alert signal when the fluid level is at the level associated with the recipient being full and the timer has expired.

In accordance with another broad aspect, there is provided a system for monitoring an engine fluid level in a fluid recipient. The system comprises a processing unit and a non-transitory computer readable medium having stored thereon program instructions. The program instructions are executable by the processing unit for, during a fluid replenishing procedure, detecting when the fluid level reaches a level associated with the recipient being full; in response to the detecting, triggering a timer corresponding to a predetermined number of operating hours of the engine based on a fluid volume capacity of the fluid recipient; when the timer expires, verifying the fluid level; and issuing a first alert signal when the fluid level is at the level associated with the recipient being full and the timer has expired.

In accordance with yet another broad aspect, there is provided a method for monitoring an aircraft engine oil level in an oil recipient. The method comprises, during an oil replenishing procedure, detecting when the oil level reaches a level associated with the recipient being full; in response to the detecting, triggering a timer corresponding to a predetermined number of operating hours of the aircraft engine based on a fluid volume capacity of the fluid recipient; when the timer expires, verifying the oil level; and issuing a first alert signal when the oil level is at the level associated with the recipient being full and the timer has expired.

Features of the systems, devices, and methods described herein may be used in various combinations, in accordance with the embodiments described herein.

BRIEF DESCRIPTION OF THE DRAWINGS

Reference is now made to the accompanying figures in which.

It will be noted that throughout the appended drawings, like features are identified by like reference numerals.

DETAILED DESCRIPTION

There is described herein a method and system for monitoring fluid levels of a fluid recipient associated with an engine, such as an aircraft engine or an engine used in an industrial setting. In some embodiments, the system comprises an oil level sensing device. Other types of fluids, such as fuel and water, are also applicable.

Figure 1:
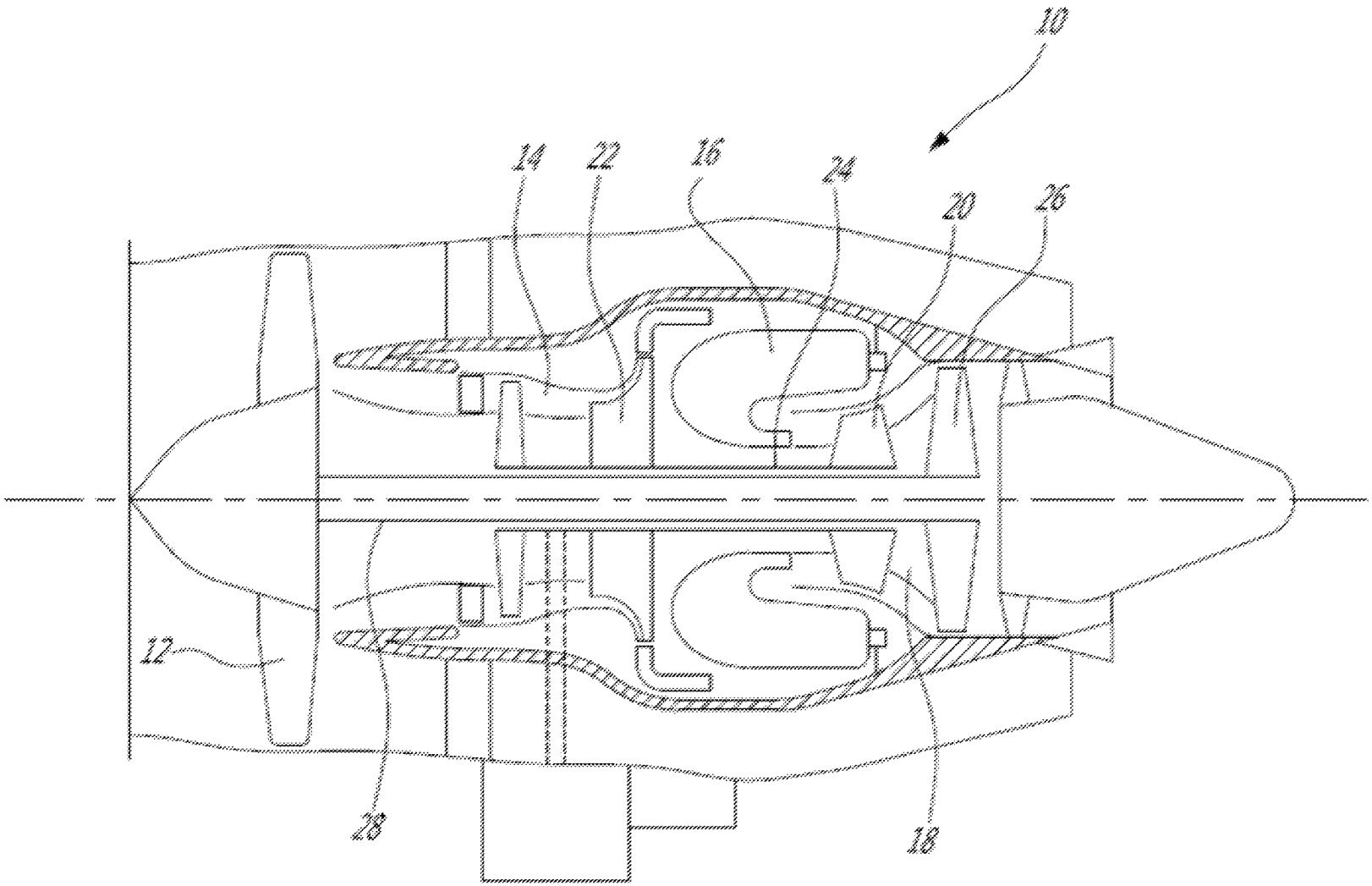
FIG. 1 is a schematic cross-sectional view of a gas turbine engine, in accordance with an illustrative embodiment.

The engine may be a gas turbine engine, such as a turbofan engine, a turboshaft engine, a turboprop engine, and the like. FIG. 1 illustrates an example gas turbine engine 10 of a type provided for use in subsonic flight, generally comprising in serial flow communication, a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. High pressure rotor(s) 20 of the turbine section 18 are drivingly engaged to high pressure rotor(s) 22 of the compressor section 14 through a high pressure shaft 24. Low pressure rotor(s) 26 of the turbine section 18 are drivingly engaged to the fan rotor 12 and to other low pressure rotor(s) (not shown) of the compressor section 14 through a low pressure shaft 28 extending within the high pressure shaft 24 and rotating independently therefrom.

Although a gas turbine engine 10 is illustrated, the system and method for fluid level monitoring may apply to any other suitable engine. In particular, the method and system for fluid level monitoring may apply to any type of engine (as well as any application and/or industry) which uses a recipient of fluid that is consumed and replenished regularly and for which it is desirable to know the level of fluid as well as the health of a fluid level sensing device used to monitor the level of fluid. For example, diesel engines, internal combustion engine, or the like, may apply.

Figure 2:
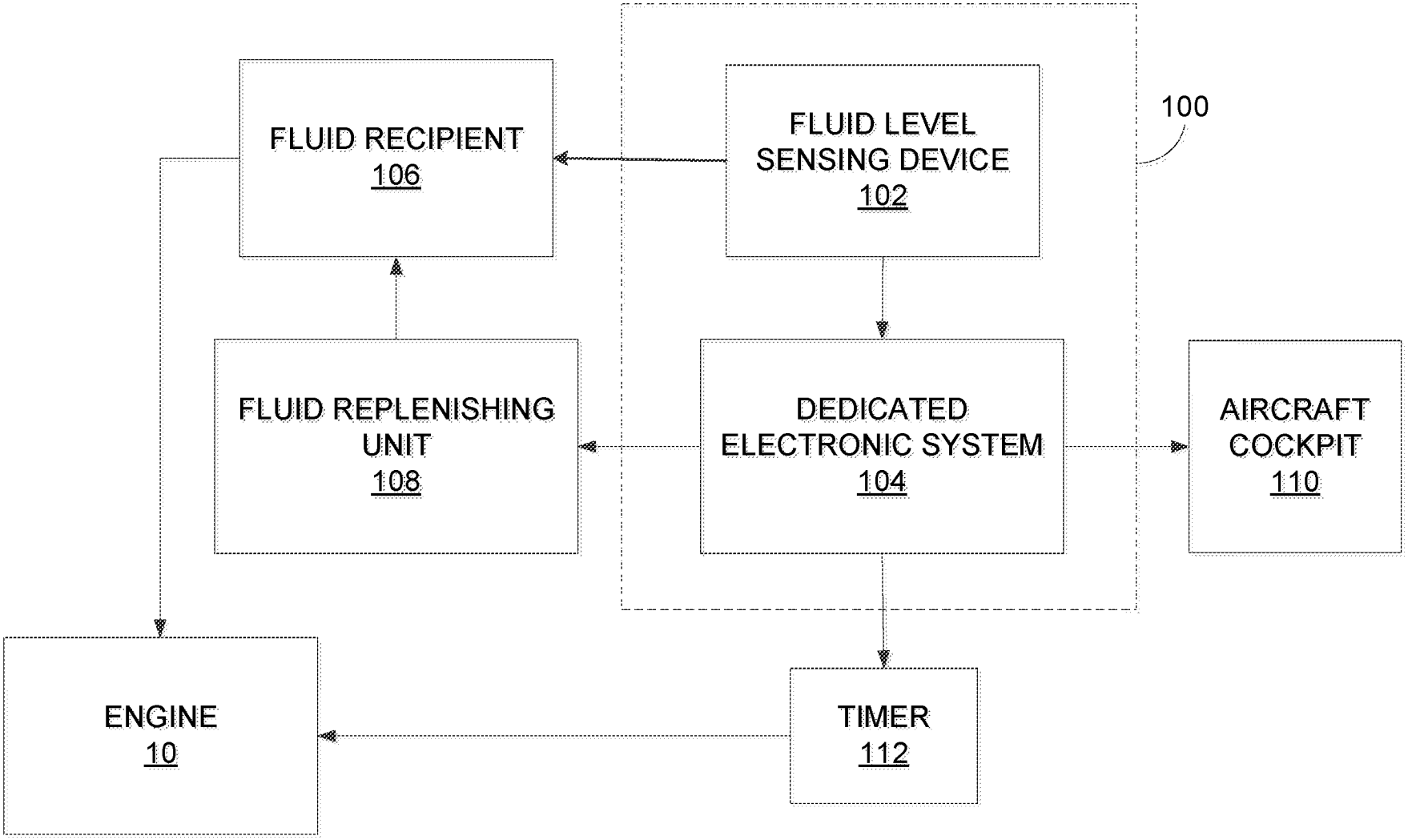
FIG. 2 is a block diagram of a fluid level monitoring system, in accordance with an illustrative embodiment.

Referring to FIG. 2, there is illustrated a fluid level monitoring system 100 comprising a fluid level sensing device 102 and a dedicated electronic system 104 operatively coupled together for communication therebetween. In some embodiments, the dedicated electronic system 104 forms part of an Electronic Engine Controller (EEC). The EEC may be part of a Full Authority Digital Engine Control (FADEC) for control of the operation and performance of the engine 10. The fluid level sensing device 102 may be used to monitor the level of any fluid (e.g. water, oil, fuel or the like) that is consumed when the engine 10 operates, the fluid being contained in any suitable vessel or recipient 106 that defines a volume of the fluid. In some embodiments, the fluid level sensing device 102 monitors the level of oil in an oil tank of the engine 10.

The fluid level sensing device 102 may be a single point, multi-point, or continuous sensing device. In some embodiments, the sensor is a magnetic float that activates one or multiple electromagnetic on/off switches to give one or multiple fluid level measurement points. Other types of sensors may also apply, such as but not limited to capacitance-type sensors for continuous monitoring, mechanical float sensors, and ultrasonic-type sensors for non-contact continuous sensing.

Figure 3:
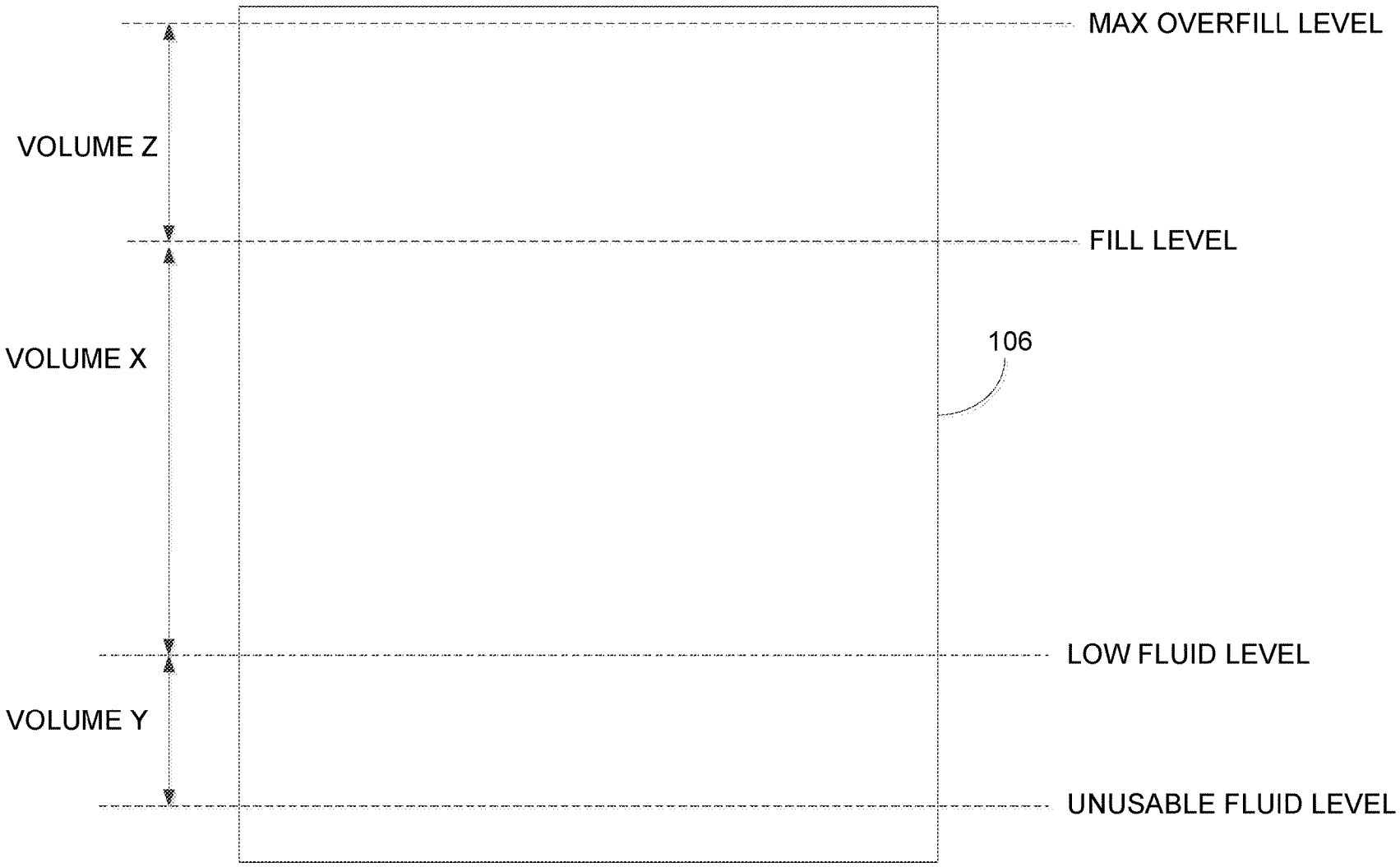
FIG. 3 is a schematic representation of a fluid recipient, in accordance with an illustrative embodiment.

In some embodiments, the fluid level sensing device 102 is configured for determining when the fluid in the recipient 106 reaches a level associated with the recipient 106 being full, referred to herein as a "fill level". FIG. 3 illustrates an example recipient 106. The fill level is shown to be below a max overfill level, which corresponds to a maximum level to which the recipient may be filled above the fill level without overflowing. The volume of fluid contained between the max overfill level and the fill level is labeled as volume Z. A volume X of fluid is contained between the fill level and a lower level, referred to as a "low fluid level". When the fluid reaches the low fluid level in the recipient 106, the recipient 106 is in need of replenishment. The volume of fluid contained between the low fluid level and a level to which the fluid is unusable is labeled as volume Y.

Referring back to FIG. 2, a fluid replenishing unit 108 is coupled to the fluid level monitoring system 100 and operative to replenish fluid in the fluid recipient 106. The fluid replenishing unit 108 may comprise a fluid pump, which may be activated to provide a fixed volume of fluid per pumping command. The fluid pump may be operated by a pilot or maintenance personnel manually. The fluid pump may also be operated automatically.

When the recipient 106 is full, the fluid level sensing device 102 detects that the fluid has reached the fill level and transmits a signal to the dedicated electronic system 104. The dedicated electronic system 104 may communicate to an aircraft cockpit 110 (or to another remote system) that the fill level has been reached, for example by activating an indicator on a display in the cockpit 110. In some embodiments, the fluid replenishing unit 108 is an aircraft subsystem and the fluid level sensing device 102 is an engine subsystem. The dedicated electronic system 104 may act as an interface between the two subsystems for communication therebetween.

In response to the fluid level sensing device 102 detecting that the fluid has reached the fill level during a replenishing procedure, the dedicated electronic system 104 triggers a timer 112. The timer 112 is configured to count a number of operating hours for the engine 10 to consume volume X of fluid from the fluid recipient 106. When the timer 112 expires, the dedicated electronic system 104 is configured to verify the fluid level in the fluid recipient 106. If the fluid level sensing device 102 indicates that the fluid is at the fill level, and the timer 112 has expired, an alert signal is issued as this would be indicative of a potential issue with the fluid level sensing device 102.

In some embodiments, the dedicated electronic system 104 is configured to trigger a replenishing procedure by the replenishing unit 108 when the fluid level is not at the fill level and the timer 112 has expired. The timer 112 may be set as a count-down to zero, starting from a predetermined number of operating hours, or as a count-up to the predetermined number of operating hours. The expression "the timer expires" will be understood to encompass both embodiments.

The predetermined number of operating hours is set to correspond to a number of operating hours for consuming the volume X of fluid in the fluid recipient 106. The number of operating hours may be determined using a known fluid consumption rate for the engine in operation. In some embodiments, the number of operating hours is determined using a maximum consumption rate (i.e. worst case scenario) for a specific engine. In some embodiments, the number of operating hours is determined using a maximum consumption rate for an engine type. In some embodiments, the operating conditions are considered for determining the number of operating hours taken to consume the volume X of fluid in the fluid recipient 106. For example, known operating conditions, average operating conditions, or worst case operating conditions may be used. In some embodiments, the number of operating hours is determined using a worst case consumption rate and worst case operation conditions. Tests and/or simulations and/or analysis may be used to determine the predetermined number of operating hours for the timer 112.

In some embodiments, volume Y of fluid corresponds to the volume of fluid needed for a longest planned flight, at a given consumption rate and in given operating conditions. Known, expected, average, or worst case consumption rates may be used. Known, expected, average, or worst case operating conditions may be used. Volume Y is provided to ensure that an engine that reaches the predetermined number of operating hours shortly after an aircraft is dispatched can safely complete its flight. Volume Y may be set to be smaller than volume Z (i.e. $Y<Z$) such that if the recipient 106 is replenished after consuming a large portion of the fluid from volume Y, and a fixed number of pumping commands are used, the max overfill level is not exceeded.

In some embodiments, the dedicated electronic system 104 is configured to monitor a number of fluid pumping commands during the fluid replenishing procedure. The actual number of fluid pumping commands may be used to monitor a fluid consumption rate of the engine, in combination with the number of operating hours of the engine.

The fluid pump may be limited to a maximum number of pumping commands, determined by taking into account the fixed volume of fluid provided per pumping command and the volume X of fluid for the recipient 106. In some embodiments, volumes Y and/or Z are also considered in determining the maximum number of pumping commands, for example, by allowing the volume of fluid pumped into the recipient to fill volume Z without exceeding it, if part or all of volume Y has been consumed. The maximum number of pumping commands may be enforced by the dedicated electronic system 104, the fluid replenishing unit 108, and/or through maintenance instructions.

In some embodiments, when the maximum number of fluid pumping commands is reached during a fluid replenishing procedure, the dedicated electronic system 104 is configured to verify the fluid level in the fluid recipient 106. If the fluid level sensing device 102 indicates that the fluid is not at the fill level and the maximum number of fluid pumping commands has been reached, an alert signal may be issued as this would be indicative of a potential issue with the fluid level sensing device 102 or with the replenishing unit 108, or of a leak in the fluid recipient 106.

Figure 4:
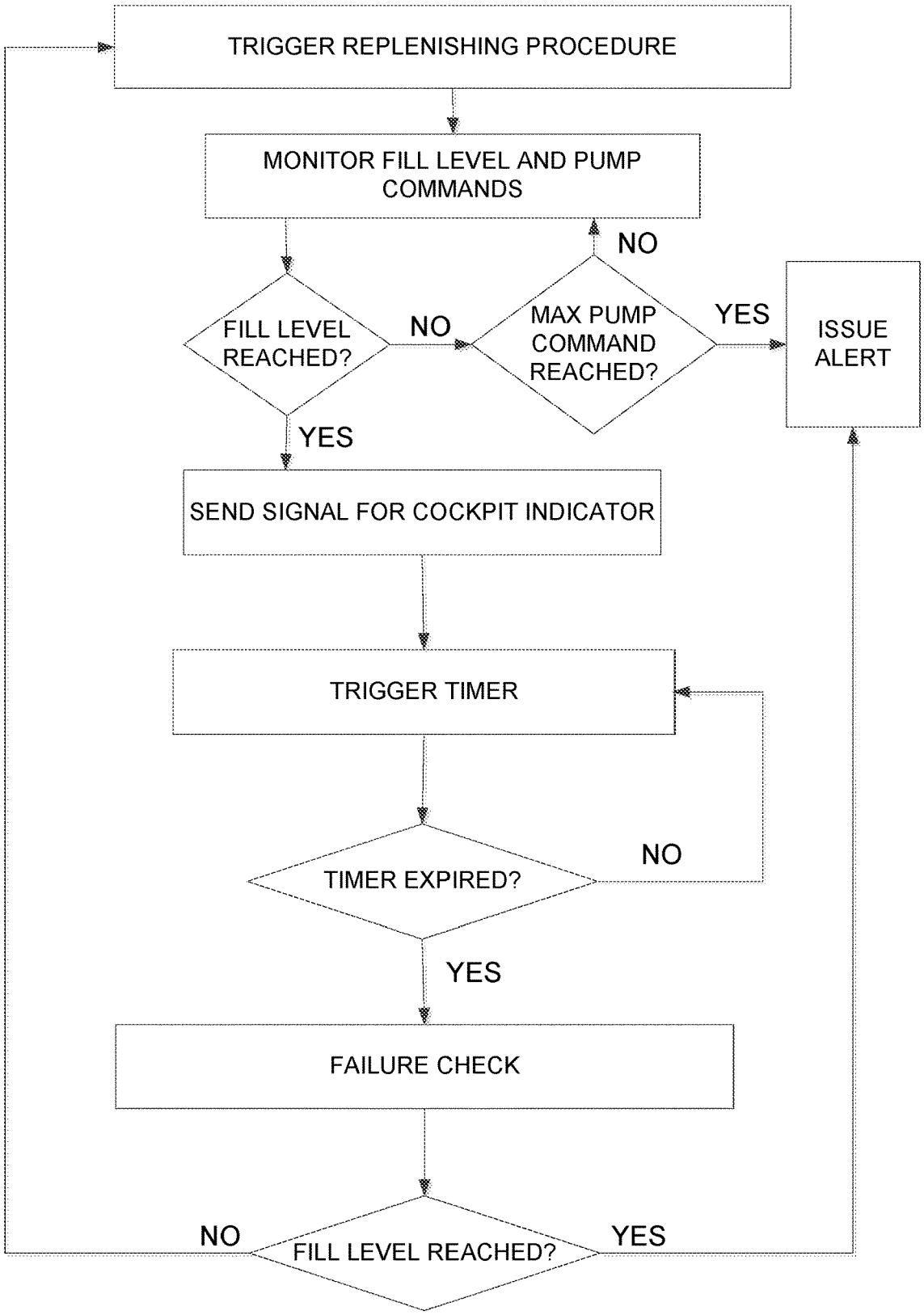
FIG. 4 is a flowchart of a method for monitoring fluid levels, in accordance with an illustrative embodiment.

A specific and non-limiting example of a method for monitoring a fluid level of an engine is illustrated in FIG. 4.

Starting from when a replenishing procedure is triggered, the fill level and pump commands are monitored during the fluid replenishing procedure. The replenishing procedure may be triggered by the dedicated electronic system 104 or by an external trigger.

As long as the fill level is not reached and the maximum number of pump commands is not reached, replenishing continues. If the fill level is not reached but the maximum number of pump commands has been reached, an alert is issued. The alert may be for a maintenance action or to set a flag for a fault. The alert may advise maintenance or operating personnel to perform a visual check of the fluid level. The aircraft may not have to be grounded if the recipient is adequately replenished and the error lies in the sensor at the fill level measurement point. A troubleshooting task to isolate the fault may be generated, to be performed when practicable.

When the fill level is reached, a signal to a monitoring system is sent and a timer is triggered. These two actions may be performed concurrently or sequentially, in any order, by the dedicated electronic system 104.

When the timer expires, a failure check for the fluid level sensing device is performed. If there is still an indication that the fluid is at the fill level after the timer has expired, an alert is issued. Otherwise, the next fluid replenishing procedure is triggered.

In some embodiments, only two components are used in addition to the hardware/software present for an aircraft engine: a sensor to detect when the fluid reaches the fill level and a timer to count the predetermined engine operating hours, and to trigger a next fluid replenishment procedure. Time and/or manpower needed for fluid replenishment is significantly reduced. The number of possible failure points is low, there is no monitoring outside of servicing procedures, and there are no impacts on aircraft dispatchability.

Figure 5:
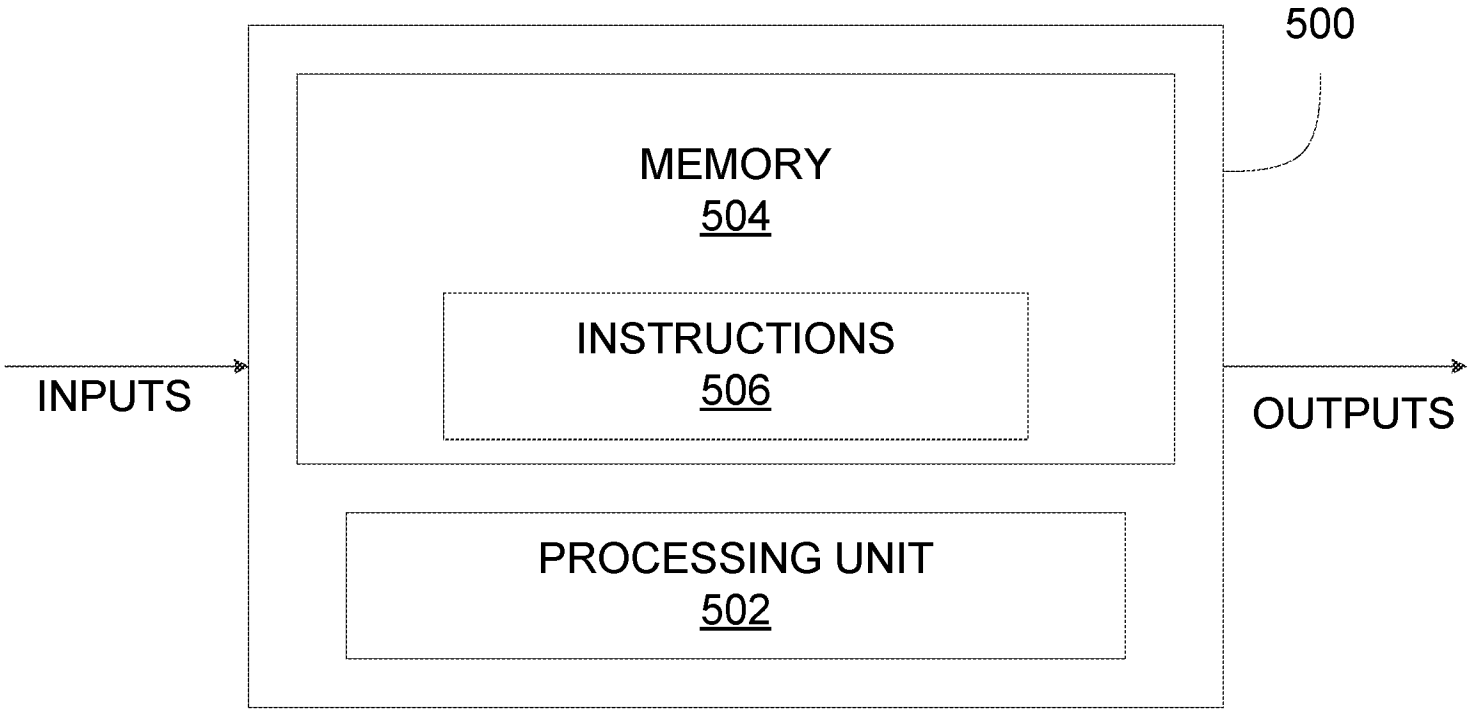
FIG. 5 is a block diagram of a computing device for implementing a fluid monitoring system, in accordance with an illustrative embodiment.

FIG. 5 is an example embodiment of a computing device 500 for implementing the dedicated electronic system 104 described above. The computing device 500 comprises a processing unit 502 and a memory 504 which has stored therein computer-executable instructions 506. The processing unit 502 may comprise any suitable devices configured to cause a series of steps to be performed such that instructions 506, when executed by the computing device 500 or other programmable apparatus, may cause the functions/acts/steps specified in the method described herein to be executed. The processing unit 502 may comprise, for example, any type of general-purpose microprocessor or microcontroller, a digital signal processing (DSP) processor, a CPU, an integrated circuit, a field programmable gate array (FPGA), a reconfigurable processor, other suitably programmed or programmable logic circuits, or any combination thereof.

The memory 504 may comprise any suitable known or other machine-readable storage medium. The memory 504 may comprise non-transitory computer readable storage medium, for example, but not limited to, an electronic, magnetic, optical, electromagnetic, infrared, or semiconductor system, apparatus, or device, or any suitable combination of the foregoing. The memory 504 may include a suitable combination of any type of computer memory that is located either internally or externally to device, for example random-access memory (RAM), read-only memory (ROM), electro-optical memory, magneto-optical memory, erasable programmable read-only memory (EPROM), and electrically-erasable programmable read-only memory (EEPROM), Ferroelectric RAM (FRAM) or the like. Memory 504 may comprise any storage means (e.g., devices) suitable for retrievably storing machine-readable instructions 506 executable by processing unit 502.

It should be noted that the computing device 500 may be implemented as part of a FADEC or other similar device, including an electronic engine control (EEC), engine control unit (ECU), engine electronic control system (EECS), and the like. In addition, it should be noted that the techniques described herein can be performed by a computing device 500 substantially in real-time.

The methods and systems for monitoring a fluid level as described herein may be implemented in a high level procedural or object oriented programming or scripting language, or a combination thereof, to communicate with or assist in the operation of a computer system, for example the computing device 500. Alternatively, the methods and systems for monitoring a fluid level may be implemented in assembly or machine language. The language may be a compiled or interpreted language. Program code for implementing the methods and systems for monitoring a fluid level may be stored on a storage media or a device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein. Embodiments of the methods and systems for monitoring a fluid level may also be considered to be implemented by way of a non-transitory computer-readable storage medium having a computer program stored thereon. The computer program may comprise computer-readable instructions which cause a computer, or more specifically the processing unit 502 of the computing device 500, to operate in a specific and predefined manner to perform the functions described herein.

Computer-executable instructions may be in many forms, including program modules, executed by one or more computers or other devices. Generally, program modules include routines, programs, objects, components, data structures, etc., that perform particular tasks or implement particular abstract data types. Typically the functionality of the program modules may be combined or distributed as desired in various embodiments.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure.

Various aspects of the methods and systems for monitoring a fluid level may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. Although particular embodiments have been shown and described, it will be obvious to those skilled in the art that changes and modifications may be made without departing from this invention in its broader aspects. The scope of the following claims should not be limited by the embodiments set forth in the examples, but should be given the broadest reasonable interpretation consistent with the description as a whole.

The invention claimed is:

1. A method for monitoring an engine fluid level in a fluid recipient, the method comprising:

during a fluid replenishing procedure, detecting when the fluid level reaches a level associated with the recipient being full;

in response to the detecting, triggering a timer corresponding to a predetermined number of operating hours of the engine based on a fluid volume capacity of the fluid recipient;

when the timer expires, verifying the fluid level; and issuing a first alert signal when the fluid level is at the level associated with the recipient being full and the timer has expired.

2. The method of claim 1, further comprising:

monitoring a number of fluid pumping commands during the fluid replenishing procedure; and limiting the number of fluid pumping commands to a maximum number.

3. The method of claim 2, further comprising:

verifying the fluid level when the maximum number of fluid pumping commands has been reached during the fluid replenishing procedure; and issuing a second alert signal when the fluid level is not at the level associated with the recipient being full and the maximum number of fluid pumping commands has been reached.

4. The method of claim 2, further comprising monitoring a consumption rate of the engine using the number of fluid pumping commands and the timer.

5. The method of claim 1, wherein detecting the fluid level comprises using a single-sensor fluid level monitoring system.

6. The method of claim 5, wherein the single-sensor is a magnetized float with a magnetically activated switch.

7. The method of claim 1, wherein the predetermined number of operating hours corresponds to a time taken for the engine to consume a first volume of the fluid in the recipient at a first predetermined consumption rate and at first predetermined operating conditions.

8. The method of claim 1, further comprising triggering the fluid replenishing procedure when the fluid level is not at the level associated with the recipient being full and the timer has expired.

9. The method of claim 1, wherein the engine is an aircraft engine, and further comprising issuing a cockpit indicator when the fluid level reaches the level associated with the recipient being full during the replenishing procedure.

10. A system for monitoring an engine fluid level in a fluid recipient, the system comprising:

a processing unit; and a non-transitory computer readable medium having stored thereon program instructions executable by the processing unit for:

during a fluid replenishing procedure, detecting when the fluid level reaches a level associated with the recipient being full;

in response to the detecting, triggering a timer corresponding to a predetermined number of operating hours of the engine based on a fluid volume capacity of the fluid recipient;

when the timer expires, verifying the fluid level; and issuing a first alert signal when the fluid level is at the level associated with the recipient being full and the timer has expired.

11. The system of claim 10, wherein the program instructions are further executable for:

monitoring a number of fluid pumping commands during the fluid replenishing procedure; and limiting the number of fluid pumping commands to a maximum number.

12. The system of claim 11, wherein the program instructions are further executable for:

verifying the fluid level when the maximum number of fluid pumping commands has been reached during the fluid replenishing procedure; and issuing a second alert signal when the fluid level is not at the level associated with the recipient being full and the maximum number of fluid pumping commands has been reached.

13. The system of claim 11, wherein the program instructions are further executable for monitoring a consumption rate of the engine using the number of fluid pumping commands and the timer.

14. The system of claim 10, wherein detecting the fluid level comprises using a single-sensor fluid level monitoring system.

15. The system of claim 14, wherein the single-sensor is a magnetized float with a magnetically activated switch.

16. The system of claim 10, wherein the predetermined number of operating hours corresponds to a time taken for the engine to consume a first volume of the fluid in the recipient at a first predetermined consumption rate and at first predetermined operating conditions.

17. The system of claim 10, further comprising triggering the fluid replenishing procedure when the fluid level is not at the level associated with the recipient being full and the timer has expired.

18. The system of claim 10, wherein the engine is an aircraft engine, and further comprising issuing a cockpit indicator when the fluid level reaches the level associated with the recipient being full during the replenishing procedure.

19. A method for monitoring an aircraft engine oil level in an oil recipient, the method comprising:

during an oil replenishing procedure, detecting when the oil level reaches a level associated with the recipient being full;

in response to the detecting, triggering a timer corresponding to a predetermined number of operating hours of the aircraft engine based on a fluid volume capacity of the fluid recipient;

when the timer expires, verifying the oil level; and issuing a first alert signal when the oil level is at the level associated with the recipient being full and the timer has expired.

20. The method of claim 19, further comprising:

monitoring a number of oil pumping commands during the oil replenishing procedure;

limiting the number of oil pumping commands to a maximum number; and issuing a second alert signal when the oil level is not at the level associated with the recipient being full and the maximum number of fluid pumping commands has been reached.

* * * * *